US005232892A

United States Patent [19]

Chang et al.

[11] Patent Number: 5,232,892

[45] Date of Patent: Aug. 3, 1993

[54] DYE RECEPTOR SHEET FOR THERMAL DYE TRANSFER IMAGING

[75] Inventors: Jeffrey C. Chang, North Oakes, Minn.; Karl F. Roenigk, Hudson, Wis.; Edward R. Harrell, Hugo; Andrew B. Becker, Woodbury, both of Minn.

[73] Assignee: Minnesota Mining and Manufacturing Company, St. Paul, Minn.

[21] Appl. No.: 753,862

[22] Filed: Sep. 3, 1991

[51] Int. Cl.[5] ..... B41M 5/035; B41M 5/38

[52] U.S. Cl. ..... 503/227; 428/195; 428/413; 428/447; 428/500; 428/913; 428/914

[58] Field of Search ..... 8/471; 428/195, 913, 428/914, 413, 447, 500; 503/227

[56] References Cited

U.S. PATENT DOCUMENTS

| | | | |
|---|---|---|---|
| 4,816,435 | 3/1989 | Murata et al. | 503/227 |
| 4,853,365 | 8/1989 | Jongewaard et al. | 503/227 |
| 4,897,377 | 1/1990 | Marbrow | 503/227 |
| 4,977,134 | 12/1990 | Jongewaard et al. | 503/227 |

FOREIGN PATENT DOCUMENTS

| | | | |
|---|---|---|---|
| 0133011A2 | 2/1986 | European Pat. Off. | 503/227 |
| 0133012A3 | 2/1986 | European Pat. Off. | 503/227 |
| 69172591 | 9/1985 | Japan . | |

OTHER PUBLICATIONS

"MR-110 Magnetic Tape Binder Resin", Nippon Zeon Co., Ltd.

EPA Form 7710-25 (12-84), Sumitomo Corporation of America, Chemical Identity Information.

WPI Acc. No.:90-167880/22 Apr. 1990.

WPI Acc. No.:90-151551/20 Apr. 1990.

WPI Acc. No.:90-093633/13 Feb. 1990.

WPI Acc. No.:90-088416/12 Feb. 1990.

WPI Acc. No.:90-078112/11 Jan. 1990.

WPI Acc. No.:89-224341/31 Jun. 1989.

WPI Acc. No.:85-259468/12 Sep. 1985.

*Primary Examiner*—B. Hamilton Hess

*Attorney, Agent, or Firm*—Gary L. Griswold; Walter N. Kirn; Mark A. Litman

[57] ABSTRACT

A dye transfer receptor sheet suitable for thermal dye transfer imaging is described. The receptor sheet provides excellent image stability characteristics. The receptor sheet comprises a substrate with a receiving layer of a vinyl chloride containing copolymer which has a glass transition temperature between 50° and 85° C., preferably about 59° and 65° C., a weight average molecular weight between about 10,000 and 100,000, preferably between 30,000 and about 50,000 g/mol, a hydroxyl equivalent weight between about 1500 and 4000, preferably about 1890 and about 3400 g/mol, a sulfonate equivalent weight between 9000 and 23,000, preferably between about 11,000 and about 19,200 g/mol, and an epoxy equivalent weight between about 500 and 7000, preferably about 1200 and about 6000 g/mol.

15 Claims, No Drawings

DYE RECEPTOR SHEET FOR THERMAL DYE TRANSFER IMAGING

FIELD OF THE INVENTION

This invention relates to thermal dye transfer printing, and in particular to a novel thermal dye transfer receptor sheet for such printing using a modified polyvinyl chloride resin.

BACKGROUND OF THE INVENTION

In thermal dye transfer printing, an image is formed on a receptor sheet by selectively transferring a dye to a receptor sheet from a dye donor sheet placed in momentary contact with the receptor sheet. Material to be transferred from the dye donor sheet is directed by a thermal printhead, which consists of small electrically heated elements (print heads). These elements transfer image-forming material from the dye donor sheet to areas of the dye receptor sheet in an image-wise manner. Thermal dye transfer systems have advantages over other thermal transfer systems, such as chemical reaction systems, thermal mass transfer systems, and sublimation dye transfer systems. In general thermal dye transfer systems offer greater control of gray scale than these other systems, but they have problems as well. One problem is release of the dye donor and receptor sheets during printing. This has been addressed often by the addition of dye-permeable release coatings applied to the surface of the dye receptor layer. Additionally, materials are required for use in the receptor layer having suitable dye permeability, mordanting properties, adhesion to the substrate, and long term light and thermal stability.

Polyvinyl chloride derivatives and copolymers have been heavily used in thermal dye transfer receptor sheets, because of their properties in these areas. For example, U.S. Pat. No. 4,853,365 discloses that chlorinated polyvinyl chloride, used as a dye receptor, has good dye solubility and high dye receptivity. Similarly, vinyl chloride/vinyl acetate copolymers have also been used in thermal dye transfer receptor sheets as described in Japanese published application nos. 29,391 (1990) and 39,995 (1990). Japanese published application no. 160,681 (1989) discloses dye acceptance layers comprising polyvinyl chloride-polyvinyl alcohol copolymers, and Japanese published application nos. 43,092 (1990), 95,891 (1990) and 108,591 (1990) discloses dye image receiving layers comprising a hydroxy modified polyvinyl chloride resin and an isocyanate compound. U.S. Pat. No. 4,897,377 discloses a thermal transfer printing receiver sheet comprising a supporting substrate coated on at least one surface with an amorphous polyester resin. Published European patent application 133,012 (1985) discloses a heat transferable sheet having a substrate and an image-receiving layer thereon comprising a resin having an ester, urethane, amide, urea, or highly polar linkage, and a dye-releasing agent, such as a silicone oil, being present either in the image-receiving layer or as a release layer on at least part of the image receiving layer. Published European patent application 133,011 (1985) discloses a heat transferable sheet based on imaging layer materials comprising first and second regions respectively comprising (a) a synthetic resin having a glass transition temperature of from −100° to 20° C., and having a polar group, and (b) a synthetic resin having a glass transition temperature of 40° C. or above.

Generally, polyvinyl chloride based polymers are photolytically unstable, decomposing to form hydrogen chloride, which in turn degrades the image-forming dyes. This has made necessary the extensive use of UV stabilizers and compounds that neutralize hydrogen chloride. The dye transfer receptor sheets of this invention employ a modified polyvinyl chloride resin that has much higher light stability than materials previously used, while retaining the desirable properties associated with polyvinyl chloride based resins.

What the background art does not disclose but this invention teaches is that epoxy/hydroxy/sulfonate functionalized polyvinyl chloride resins are particularly useful components in the construction of thermal dye transfer receptor sheets having improved dye image stability.

SUMMARY OF THE INVENTION

It is an aspect of the invention to provide a thermal dye transfer receptor element for thermal dye transfer in intimate contact with a dye donor sheet, the receptor comprising a supporting substrate having on at least one surface thereof a dye receptive receiving layer comprising a vinyl chloride containing copolymer which has a glass transition temperature between about 59° and 65° C., a weight average molecular weight between about 30,000 and about 50,000 g/mol, a hydroxyl equivalent weight between about 500 or 1000 and about 7000 g/mol, a sulfonate equivalent weight between about 11,000 and about 19,200 g/mol, and an epoxy equivalent weight between about 500 and about 7000 g/mol. The donor sheet comprises a substrate with a dye donor layer coated thereon, and the dye receptive receiving layer is in intimate contact with said dye donor layer.

It is another aspect of this invention to provide thermal dye transfer receptor sheets as described above wherein a polysiloxane release layer is coated on the dye receptive receiving layer.

The thermal dye transfer receptor sheets of the invention have good dye receptivity and excellent dye-image thermal stability properties.

DETAILED DESCRIPTION OF THE INVENTION

The thermal dye transfer receptor sheets of the invention comprise a supporting substrate having a dye receptive layer on at least one surface. The dye receptive layer is optionally coated with a polysiloxane release layer.

Problems with presently used dye receiving layer systems include poor shelf-life of the dye in the donor sheet, blooming of the dye (i.e., movement out of the resin system), and bleeding of the dye (i.e., transfer of dye from the dye receiving layer onto another material in contact with it). In addition, polyvinyl chloride based resins are prone to shelf-life problems since they decompose to form hydrogen chloride on exposure to light.

Accordingly, in the present invention it has been found that a vinyl chloride containing copolymer which has a glass transition temperature between about 59° and 65° C., a weight average molecular weight between about 30,000 and about 50,000 g/mol, a hydroxyl equivalent weight between about 1890 and about 3400 g/mol, a sulfonate equivalent weight between about 11,000 and about 19,200 g/mol, and an epoxy equivalent weight between about 500 and about 7000 g/mol provide good dye receptivity while substantially increasing shelf-life of the dye image. Copolymers useful in this invention are commercially available from Nippon Zeon Co., (Tokyo, Japan) under the trade names MR-110, MR-113, and MR-120. Alternatively, they may be prepared according to the methods described in U.S. Pat. Nos. 4,707,411, 4,851,465, or 4,900,631 which are herein incorporated by reference.

Suitable comonomers for polymerization with polyvinyl chloride are likewise included in the above cited patents. They include but are not limited to epoxy containing copolymerizable monomers such as (meth)acrylic and vinyl ether monomers such as glycidyl methacrylate, glycidyl acrylate, glycidyl vinyl ether, etc. Sulfonated copolymerizable monomers include but are not limited to (meth)acrylic monomers such as ethyl (meth-)acrylate-2-sulfonate, vinyl sulfonic acid, allylsulfonic acid, 3-allyloxy-2-hydroxypropanesulfonic acid, styrene sulfonic acid and metal and ammonium salts of these compounds. Hydroxyl group containing copolymerizable monomers include but are not limited to hydroxylated (meth)acrylates such as 2-hydroxyethyl (meth)acrylate 2-hydroxybutyl (meth)acrylate; alkanol esters of unsaturated dicarboxylic acid such as mono-2-hydroxypropyl maleate and di-2-hydroxypropyl maleate and mono-2-hydroxybutyl itaconate, etc.; olefinic alcohols such as 3-buten-1-ol, 5-hexen-1-ol, 4-penten-1-ol, etc. Additional comonomers that may be copolymerized in minor amounts not to exceed 5% by weight in total include alkyl (meth)acrylate esters such as methyl (meth)acrylate, propyl (meth)acrylate, and the like; and vinyl esters such as vinyl acetate, vinyl propionate, vinyl butyrate and the like.

The dye image receptor layer must be compatible as a coating with a number of resins, since most commercially available dye donor sheets are resin based. Since different manufacturers generally use different resin formulations in their donor sheets, the dye receiving layer should have an affinity for several different resins. Because the transfer of dye from the dye donor sheet to the dye receptor sheet is essentially a contact process, it is important that there be intimate contact (e.g., no air gaps or folds) between the dye donor sheet and the dye receptor sheet at the instant of heating to effect imaging.

The proper selection of softening temperature (e.g. glass transition temperature, Tg) of the dye receiving layer is important in the preparation of the thermal dye transfer receptor sheet. Preferably the dye receiving layer should soften at or slightly below the temperatures employed to transfer dye from the dye donor sheet. The softening point, however, must not allow the resin to become distorted, stretched, wrinkled, etc. In addition, the dye receptor sheet is preferably non-tacky and capable of being fed reliably into a thermal printer, and is of sufficient durability that it will remain useful after handling, feeding, and removal from processing.

The dye receptor sheet may be prepared by introducing the various components for making the dye receiving layer into suitable solvents (e.g., tetrahydrofuran (THF), methyl ethyl ketone (MEK), and mixtures thereof, MEK/toluene blends mixing the resulting solutions at room temperature (for example), then coating the resulting mixture onto the substrate and drying the resultant coating, preferably at elevated temperatures. Suitable coating techniques include knife coating, roll coating, curtain coating, spin coating, extrusion die coating, gravure coating, etc. The dye receiving layer is preferably free of any observable colorant (e.g., an optical density of less than 0.2, preferably less than 0.1 absorbance units). The thickness of the dye receiving layer is from about 0.001 mm to about 0.1 mm, and preferably 0.005 mm to 0.010 mm.

Materials that have been found useful for forming the dye receiving layer include sulfonated hydroxy epoxy functional vinyl chloride copolymers as described above, and in another embodiment blends of sulfonated hydroxy epoxy functional vinyl chloride copolymers with other polymers. The limiting factors to the resins chosen for the blend vary only to the extent of compounding necessary to achieve the property desired. Preferred blendable additives include, but are not limited to polyvinyl chloride, acrylonitrile, styrene-acrylonitrile copolymers, polyesters (especially bisphenol A fumaric acid polyester), acrylate and methacrylate polymers (especially polymethyl methacrylate), epoxy resins, and polyvinyl pyrrolidone. When an additional polymer, copolymer, or resin is used it is usually added in an amount of 75 percent by weight or less of the resinous composition of the dye receiving layer, preferably in the amount of 30 to 75 percent by weight for non-release polymers, or 0.01 to 15% for release polymers.

Release polymers are characterized by low surface energy and include silicone and fluorinated polymers. Non-limiting examples of release polymers are poly dimethyl siloxanes, perfluorinated polyethers, etc.

Suitable substrate materials may be any flexible material to which an image receptive layer may be adhered. Suitable substrates may be smooth or rough, transparent, opaque, and continuous or sheetlike. They may be porous or essentially non-porous. Preferred backings are white-filled or transparent polyethylene terephthalate or opaque paper. Non-limiting examples of materials that are suitable for use as a substrate include polyesters, especially polyethylene terephthalate, polyethylene naphthalate, polysulfones, polystyrenes, polycarbonates, polyimides, polyamides, cellulose esters, such as cellulose acetate and cellulose butyrate, polyvinyl chlorides and derivatives, polyethylenes, polypropylenes, etc. The substrate may also be reflective such as in baryta-coated paper, an ivory paper, a condenser paper, or synthetic paper. The substrate generally has a thickness of 0.05 to 5 mm, preferably 0.05 mm to 1 mm.

By "non-porous" in the description of the invention it is meant that ink, paints and other liquid coloring media will not readily flow through the substrate (e.g., less than 0.05 ml per second at 7 torr applied vacuum, preferably less than 0.02 ml per second at 7 torr applied vacuum). The lack of significant porosity prevents absorption of the heated receptor layer into the substrate.

The thermal dye transfer receptor layers of the invention are used in combination with a dye donor sheet wherein a dye image is transferred from the dye donor sheet to the receptor sheet by the application of heat. The dye donor layer is placed in contact with the dye receiving layer of the receptor sheet and selectively heated according to a pattern of information signals whereby the dyes are transferred from the donor sheet to the receptor sheet. A pattern is formed thereon in a shape and density according to the intensity of heat applied to the donor sheet. The heating source may be an electrical resistive element, a laser (preferably an infrared laser diode), an infrared flash, a heated pen, or the like. The quality of the resulting dye image can be improved by readily adjusting the size of the heat source that is used to supply the heat energy, the contact place of the dye donor sheet and the dye receptor sheet, and the heat energy. The applied heat energy is controlled to give light and dark gradation of the image and for the efficient diffusion of the dye from the donor sheet to ensure continuous gradation of the image as in a photograph. Thus, by using in combination with a dye donor sheet, the dye receptor sheet of the invention can be utilized in the print preparation of a photograph by printing, facsimile, or magnetic recording systems wherein various printers of thermal printing systems are used, or print preparation for a television picture, or cathode ray tube picture by operation of a computer, or a graphic pattern or fixed image for suitable means such as a Video camera, and in the production of progressive patterns from an original by an electronic scanner that is used in photomechanical processes of printing.

Suitable thermal dye transfer donor sheets for use in the invention are well known in the thermal imaging art. Some examples are described in U.S. Pat. No. 4,853,365 which is hereby incorporated by reference.

Other additives and modifying agents that may be added to the dye receiving layer include UV stabilizers, heat stabilizers, suitable plasticizers, surfactants, release agents, etc., used in the dye receptor sheet of the present invention.

In a preferred embodiment, the dye receiving layer of the invention is overcoated with a release layer. The release layer must be permeable to the dyes used under normal transfer conditions in order for dye to be transferred to the receiving layer. Release materials suitable for this layer may be fluorinated polymers such as polytetrafluoroethylene, and vinylidene fluoride/vinylidene chloride copolymers, and the like, as well as dialkylsiloxane based polymers such as polydimethylsiloxane, polyvinyl butyral/siloxane copolymers such as Dai-Allomer TM SP-711 (manufactured by Daicolor Pope, Inc., Rock Hill, S.C.) and urea-polysiloxane polymers.

Alternatively, improved release properties may be achieved by addition of a silicone or mineral oil to the dye receiving layer during formulation.

EXAMPLES

The term "PVC" refers to polyvinyl chloride.

The term "PET" refers to polyethylene terephthalate.

The term "Meyer bar" refers to a wire wound rod such as that sold by R & D Specialties, Webster, N.Y.

The following dyes are used in the examples that follow:

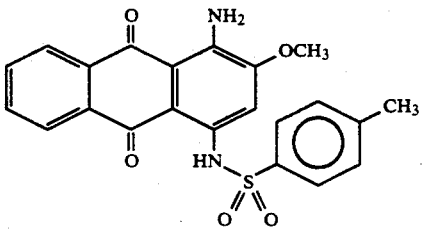

AQ-1

-continued

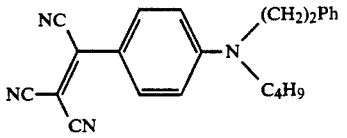

Mitsubishi Dye HSR-31
U.S. 4,816,435

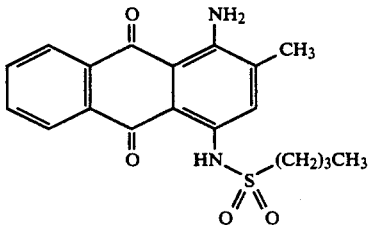

Butyl Magenta

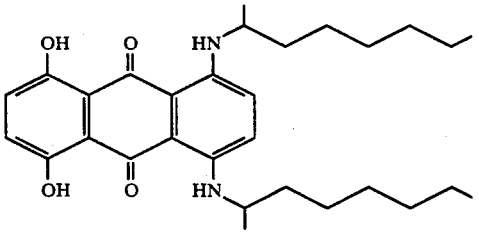

Octyl Cyan

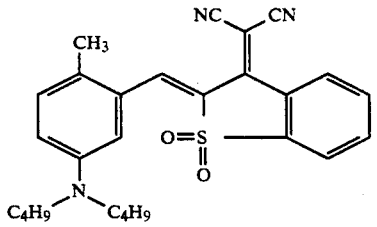

Foron Brilliant Blue

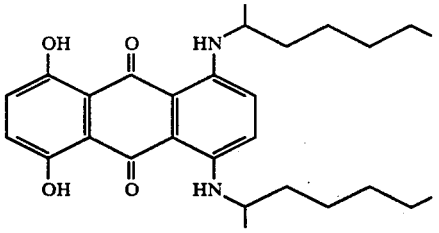

Heptyl Cyan

Butyl Magenta may be prepared as described in U.S. Pat. No. 4,977,134 (Smith et al.); HSR-31 was purchased from Mitsubishi Kasel Corp., Tokyo, Japan; AQ-1 was purchased from Alfred Bader Chemical (Aldrich Chemical Co., Milwaukee, WI); Foron Brilliant Blue was obtained from Sandoz Chemicals, Charlotte, NC; Heptyl Cyan and Octyl Cyan were prepared according to the procedures described in Japanese published application 60-172,591.

EXAMPLE 1

This example describes the preparation of a dye receptor layer containing a multi-functionalized polyvinyl chloride and its use.

A solution containing 10 wt % MR-120 (a vinyl chloride copolymer, hydroxy equivalent weight 1890 g/mol, sulfonate equivalent weight 19200 g/mol, epoxy equivalent weight 5400 g/mol, $T_g$=65° C., $M_w \approx 30,000$ obtained from Nippon Zeon Co., Tokyo, Japan) and 1.5 wt % Fluorad TM FC-431 (a fluorinated surfactant available from 3M Company, St. Paul, MN) in MEK was knife coated onto 4-mil (0.1 mm) PET film at a 4 mil (0.1 mm) wet film thickness. The coated film was then dried.

A gravure coated magenta colored dye donor sheet composed of:

| | |
|---|---|
| AQ-1 (1-amino-2-methoxy-4-(4-methylbenzenesulfonamido)anthraquinone) | 3.61 wt % |
| HSR-31 | 32.49 wt % |
| Geon ® 178 (polyvinyl chloride, B.F. Goodrich Co., Cleveland, OH) | 37.7 wt % |
| Goodyear Vitel TM PE-200 (Goodyear Chemicals Co., Akron, OH) | 2.7 wt % |
| RD-1203 (a 60/40 blend of polyoctadecyl acrylate and polyacrylic acid, 3M Company, St. Paul, MN) | 15.0 wt % |
| Troysol TM CD 1 (CAS registry no.: 64742-88-7, purchased from Troy Chemical, Newark, NJ) | 8.5 wt % |

was coated onto 5.7 micron Teijin F22G polyester film (Teijin Ltd., Tokyo, Japan) at a dry coating weight of 0.7 g/m$^2$.

This donor sheet was used to transfer the dye to the receptor using a thermal printer. The printer used a Kyocera raised glaze thin film thermal print head (Kyocera Corp., Kyoto, Japan) with 8 dots per mm and 0.3 watts per dot. In normal imaging, the electrical energy varies from 0 to 16 joules/cm$^2$, which corresponds to head voltages from 0 to 14 volts with a 23 msec burn time.

The dye donor and receptor sheets were assembled and imaged with the thermal print head with a burn time of 23 msec at 16.6 volts, and a heating profile (70–255 msec on/0–150 msec off) with 8 step gradations. The resultant transferred image density (i.e., reflectance optical density) at the 7$^{th}$ was 1.53 as measured by a MacBeth TR527 densitometer (Status A filter).

The transferred images were then tested for ultraviolet light (UV) stability in an accelerated UV test device, UVcon TM (Atlas Electric Devices Co., Chicago, IL) equipped with eight 40 watt UVA-351 fluorescent lamps at 351 nm and 50° C. for 121 hours. The loss in image density was 48%.

COMPARATIVE EXAMPLE A

A receptor sheet comprising NCAR ® VYNS-3 (a vinyl chloride/vinyl acetate copolymer, 9:1 by weight, $M_n$=44,000, Union Carbide, Danbury, CT), in place of MR-120, coated onto PET film was prepared as in Example 1. After transfer of the donor sheet dyes, as described in Example 1, the image density at the 7$^{th}$ step was 1.50. Following UV exposure as described in Example 1, the resultant loss in image density was 82%.

COMPARATIVE EXAMPLE B

A receptor sheet comprising UCAR ® VAGH (a vinyl chloride/vinyl acetate/vinyl alcohol copolymer, 90:4:6 by weight, $M_n$=27,000, in place of MR-120, coated onto PET film was prepared as in Example 1.

After transfer of the donor sheet dyes, as described in Example 1, the image density at the 7$^{th}$ step was 1.57. Following UV exposure as described in Example 1, the resultant loss in image density was 72%.

Example 1 and comparative Examples A and B demonstrate that the claimed receiver layer has good receptivity and improved UV stability.

EXAMPLE 2

This example describes the preparation and comparison of dye receptor sheets employing different PET substrates.

The first PET substrate (Substrate A) was a heat treated 4 mil (0.1 mm) PET clear film (describe), while the second PET substrate (Substrate B) was 4 mil PET film primed on one side with poly(vinylidene chloride).

A receptor layer solution was coated onto Substrate A and the unprimed side of Substrate B using a #12 Meyer bar to give a 0.152 mm wet thickness film.

The receptor layer solution was composed of:

| | |
|---|---|
| 2.89 wt % | Atlac TM 382ES (a trademarked bisphenol A fumarate polyester obtained from ICI America, Wilmington, DE) |
| 2.33 wt % | Temprite TM 678 × 512 (a trademarked 62.5% chlorinated PVC obtained from B.F. Goodrich, Cleveland, OH) |
| 0.47 wt % | Epon TM 1002 (a trademarked epoxy resin obtained from Shell Chemical, Houston, TX) |
| 0.47 wt % | Vitel TM PE200 (a trademarked polyester obtained from Goodyear, Akron, OH) |
| 0.58 wt % | Fluorad TM FC 430 (a trademarked fluorocarbon surfactant obtained from 3M Company, St. Paul, MN) |
| 0.17 wt % | Tinuvin TM 328 (a UV stabilizer obtained from Ciba-Geigy, Ardsley, NY) |
| 0.29 wt % | Uvinul TM N539 (a UV stabilizer obtained from BASF, New York, NY) |
| 0.58 wt % | Therm-Check ® 1237 (a cadmium containing heat stabilizer obtained from Ferro Chemical Division, Bedford, OH) |
| 0.93 wt % | 4-dodecyloxy-2-hydroxybenzophenone (obtained from Eastman Chemical) |
| 25.17 wt % | methyl ethyl ketone |
| 66.12 wt % | tetrahydrofuran |

Dye receptivity was tested by transferring from cyan and magenta donor sheets through a thermal printer having a Kyocera raised glaze thin film print head with 8 dots per mm at 0.3 watts per dot.

The magenta donor sheet was prepared as in Example 1 using the following magenta donor layer formulation:

| | |
|---|---|
| Butyl Magenta | 8.42 wt % |
| HSR-31 | 33.68 wt % |
| Geon ® 178 | 39.4 wt % |
| Vitel TM PE 200 | 2.8 wt % |
| RD-1203 | 15.7 wt % |

and coated to a dry thickness of 0.7 g/m$^2$ onto 5.7 micron Teijin F22G polyester film.

The cyan donor sheet was prepared as in Example 1 using the following cyan donor layer formulation:

| | |
|---|---|
| Heptyl Cyan | 17.8 wt % |
| Octyl Cyan | 17.8 wt % |
| Foron Brilliant Blue | 17.8 wt % |
| Geon ® 178 | 35.59 wt % |
| Vitel TM PE 200 | 3.56 wt % |
| RD-1203 | 7.45 wt % |

and coated to a dry thickness of 0.7 g/m$^2$ onto 5.7 micron Teijin F22G polyester film.

Dye donor and receptor sheets were assembled and imaged with the thermal print head with a burn time of 23 msec at 16.5 volt and a burn profile of 70–255 msec on and 0–150 msec off. Eight levels of gradation were used. The resultant transferred image density (ROD) was measured with a MacBeth TR527 densitometer and tested for UV stability in a UVcon (Atlas Electric Devices Co., Chicago, IL) equipped with eight 40 watt UVA-351 fluorescent lamps at 351 nm and 50° C. for 46.5 hours. The results for levels 6 and 8 are summarized in Table 1.

TABLE 1

| | | Initial Image Density | | % Loss in ROD | |
|---|---|---|---|---|---|
| Donor Used | Level | Substrate A | Substrate B | Substrate A | Substrate B |
| Magenta | 6 | 1.34 | 1.29 | 41.8 | 75.2 |
| | 8 | 1.44 | 1.40 | 47.9 | 78.6 |
| Cyan | 6 | 2.13 | 2.11 | 18.8 | 25.6 |
| | 8 | 2.33 | 2.22 | 5.2 | 6.8 |

Table 1 demonstrates that dye receptivities of the claimed receptors are comparable in terms of image density. Better UV stability was observed on the heat-treated polyester substrate (Substrate A).

EXAMPLE 3

This example describes the preparation and performance of dye receptors containing MR-120 and UV absorbers. Several commercially available UV absorbers were incorporated with multifunctional PVC (i.e., MR-120) into a dye receptive layer. A control coating solution containing 9.8 wt % MR-120 resin and 1.2 wt % Fluorad TM FC-430 in MEK was coated on Substrate A with a #12 Meyer bar at a wet film thickness of 5 mils. After drying, the receptor was tested for dye receptivity and image UV stability as described in Example 2. The magenta donor sheet contained HSR-31/Butyl Magenta at a 4 to 1 ratio. Similar receptor solutions were prepared with addition of UV absorbers in the amount of 3.34 g UV absorber per 59.9 g of MR-120. The results are shown in Table 2.

TABLE 2

| Stabilizer | Initial Image Density at 14 volts, ROD | % Loss in ROD After 90 hr UV Exposure |
|---|---|---|
| None | 0.86 | 55.9 |
| Tinuvin TM 144 (a hindered amine light stabilizer) | 0.89 | 70.8 |
| Uvinul TM 490 (a mixture of 2-hydroxy-4-methoxybenzophenone and other tetra-substituted benzophenones) | 0.91 | 59.3 |
| Uvinul TM N-539 (2-ethylhexyl 2-cyano-3,3-diphenylacrylate) | 1.03 | 56.3 |
| Ferro ® UV-Chek ® AM300 (2-hydroxy-4-n-octyloxybenzophenone) | 0.98 | 41.8 |
| Uvinul TM 400 (2,4-dihydroxybenzophenone) | 1.09 | 48.6 |
| Tinuvin TM 622LD (a hindered amine light stabilizer) | 1.10 | 74.6 |
| Uvinul TM M-40 (2-hydroxy-4-methoxybenzophenone) | 1.11 | 61.3 |
| Uvinul TM N-35 (Ethyl 2-cyano-3,3-diphenylacrylate) | 1.10 | 54.6 |
| Tinuvin 328 2-(3,4-di-t-amyl-2-hydroxyphenyl)-2H-1,2,3-benzotriazole) | 1.03 | 71.8 |

EXAMPLE 4

This example describes the preparation of two different dye receptors employing other multi-functionalized polyvinyl chloride copolymers.

The first receptor was prepared by coating a solution of 10 wt % MR-110 (a vinyl chloride containing copolymer; hydroxy equivalent weight 3400 g/mol, sulfonate equivalent weight 13000 g/mol, epoxy equivalent weight 1600 g/mol, $T_g$=59° C., $M_w \approx 43{,}400$ obtained from Nippon Zeon Co., Tokyo, Japan) and 1.5 wt % Fluorad TM FC-431 (a fluorochemical surfactant obtained from 3M Company, St. Paul, MN) in methyl ethyl ketone onto a 4 mil (0.1 mm) heat stabilized polyethylene terephthalate (PET) film with a wire wound bar at 3 mil (0.075 mm) gap. The coated film was then dried.

The second receptor was prepared in the same fashion except that MR-113 (a vinyl chloride copolymer; hydroxy equivalent weight 2400 g/mol, sulfonate equivalent weight 11000 g/mol, epoxy equivalent weight 2100 g/mol, $T_g$=62° C., $M_w \approx 50{,}200$ obtained from Nippon Zeon Co., Tokyo, Japan) was used in place of MR-110.

A gravure coated magenta-colored dye donor sheet composed of HSR-31/Butyl Magenta dyes in a 4:1 ratio was used to transfer the dyes to the receptors through a thermal printer. The printer used a Kyocera raised glaze thin film thermal print head with 8 dots per mm and 0.3 watts per dot. In normal imaging, the electrical energy varies from 0 to 16 joules/cm$^2$, which corresponds to head voltages from 0 to 14 volts with a 23 msec burn time.

The dye donor and receptor sheets were assembled and imaged with the thermal print head with a burn time of 23 msec at 11, 12, and 13 volts, and a heating profile with multiple and varying duration heating pulses and delays between pulses (70–255 msec on/-0–150 msec off). The resulting image density was measured on a MacBeth TR527 densitometer with Status-A filter (MacBeth Instrument Co., Newburgh, NY). The reflectance optical densities of the transferred images were 0.77, 1.28, and 1.62 on the first receptor, and 0.78, 1.25, and 1.62 on the second receptor at 11, 12, and 13 volts respectively.

The transferred images were then tested for ultraviolet light (UV) stability in an accelerated UV test device, UVcon (Atlas Electric Devices Co., Chicago, IL) equipped with eight 40 watt UVA-351 fluorescent lamps at 351 nm and 50° C. for 69 hours. The average loss in image density was 38.5% for the first receptor and 35.3% for the second receptor.

COMPARATIVE EXAMPLE C

A receptor sheet was prepared, tested, and evaluated as in Example 4 except that VYNS (see comparative Example A) was used in place of the MR-110 . The image densities were 0.71, 1.17, and 1.61 at 11, 12and 13 volts, respectively. Following accelerated UV exposure as described in Example 4, the resultant loss in image density was 64.7% on the average.

COMPARATIVE EXAMPLE D

A receptor sheet was prepared, tested, and evaluated as in Example 4 except that VAGH TM (a vinyl resin lopolymer manufactured by Union Carbide) was used in place of the MR-110. The image densities were 0.66, 1.19, and 1.58 at 11, 12, and 13 volts, respectively. Following accelerated UV exposure as described in Example 4, the resultant loss in image density was 52.3% on the average.

EXAMPLE 5

This example illustrates the use of a top coat release layer in the construction of the thermal dye transfer receptor sheet.

A dye receiving layer formulation having the following composition was prepared: MR-120 (34.72 wt %), Atlac TM 382 ES (34.72 wt %), Epon TM 1002 (6.17 wt %), Ferro ® UV-Chek ® AM-300 (13.34 wt %), 70% Troysol TM CD 1 (11.05 wt %). A 17% solids solution of the above mixture in MEK was coated onto 4 mil (0.1 mm) heat stabilized polyester at a wet thickness of 0.044 mm using a slot-die (slot-orifice) coater. The coating was dried to a coating weight of 6 g/m$^2$ by passing the coated polyester web at 15.2 m/s through a 30-foot oven having a temperature range of 65° to 93° C.

The receptor sheet coated above was then coated with a one weight percent solution of Dai-Allomer TM SP-711 (a polyvinyl butyral/siloxane copolymer) in MEK solvent which was then dried to give a coating weight of 0.1 g/m$^2$.

The coated receptor sheets were imaged with cyan and magenta dye donor sheets and tested for dye image UV stability as described in Example 2.

TABLE 3

| | Magenta Image | | Cyan Image | |
|---|---|---|---|---|
| Receptor Sheet | Reflected Optical Density | % Loss | Reflected Optical Density | % Loss |
| No Topcoat | | | | |
| 13 volts | 0.67 | 25.4 | 0.57 | 28.1 |
| 15 volts | 1.32 | 30.3 | 1.18 | 32.2 |
| 17 volts | 1.65 | 22.4 | 2.18 | 25.2 |
| SP-711 Topcoat | | | | |
| 13 volts | 0.62 | 37.1 | 0.46 | 32.6 |
| 15 volts | 1.18 | 28.8 | 1.00 | 34.0 |
| 17 volts | 1.51 | 19.9 | 1.90 | 24.7 |

We claim:

1. A thermal dye transfer system comprising a thermal dye transfer receptor element in intimate contact with a thermal dye donor sheet, said receptor element comprising a substrate having, on at least one surface thereof in contact with said dye transfer donor sheet, a dye receptive receiving layer comprising a vinyl chloride copolymer having a glass transition temperature between 50° and 85° C., a weight average molecular weight between 10,000 and 100,000 g/mol, a hydroxyl equivalent weight between 1000 and 7000 g/mol, a sulfonate equivalent weight between 5,000 and 40,000 g/mol, and an epoxy equivalent weight between 500 and 7000 g/mol.

2. The thermal dye transfer system of claim 1 wherein a polysiloxane release layer is coated on said dye receptive receiving layer.

3. The thermal dye transfer system of claim 2 wherein the dye receptive receiving layer further comprises an ultraviolet radiation absorber.

4. The thermal dye transfer system of claim 2 wherein said dye receptive receiving layer comprises a mixture of said vinyl chloride copolymer and another polymer, said copolymer comprising at least 25% of weight of polymeric material in said dye receptive receiving layer.

5. The thermal dye transfer system of claim 1 wherein the dye receptive receiving layer further comprises an ultraviolet radiation absorber.

6. The thermal dye transfer system of claim 5 wherein said dye receptive receiving layer comprises a mixture of said vinyl chloride copolymer and another polymer, said copolymer comprising at least 25% of weight of polymeric material in said dye receptive receiving layer.

7. The thermal dye transfer system of claim 6 wherein said thermal dye donor sheet comprises a substrate having on only one surface thereof a layer comprising a thermally transferrable dye.

8. The thermal dye transfer system of claim 1 wherein said dye receptive receiving layer comprises a mixture of said vinyl chloride copolymer and another polymer, said copolymer comprising at least 25% of weight of polymeric material in said dye receptive receiving layer.

9. The thermal dye transfer system of claim 1 wherein said thermal dye donor sheet comprises a substrate having on only one surface thereof a layer comprising a thermally transferrable dye.

10. A process of transferring an image using the thermal dye transfer system of claim 1 wherein heat is applied in an imagewise distribution to a side of said thermal dye donor sheet farthest from said dye receiving layer, said heat being applied in an amount sufficient to thermally transfer dye.

11. A thermal dye transfer system comprising a thermal dye transfer receptor element in intimate contact with a thermal dye donor sheet, said receptor element comprising a substrate having, on at least one surface thereof in contact with said dye transfer donor sheet, a dye receptive receiving layer comprising a vinyl chloride copolymer having a glass transition temperature between 55° and 70° C., a weight average molecular weight between 20,000 and 60,000 g/mol, a hydroxyl equivalent weight between 1500 and 4000 g/mol, a sulfonate equivalent weight between 9,000 and 23,000 g/mol, and an epoxy equivalent weight between 500 and 7000 g/mol.

12. The thermal dye transfer system of claim 11 wherein a polysiloxane release layer is coated on said dye receptive receiving layer.

13. An image bearing sheet comprising a substrate having, on at least one surface thereof a dye receptive receiving layer comprising a vinyl chloride copolymer having a glass transition temperature between 59° and 65° C., a weight average molecular weight between 25,000 and 55,000 g/mol, a hydroxyl equivalent weight between 1890 and 3400 g/mol, a sulfonate equivalent weight between 11,000 and 19,200 g/mol, and an epoxy equivalent weight between 500 and 7000 g/mol, and on said dye receptive layer at least one dye distributed in an imagewise manner.

14. The sheet of claim 13 wherein a polysiloxane release layer is coated on said dye receptive receiving layer.

15. The sheet of claim 13 wherein said image comprises at least three different color dyes on said dye receptive layer.

* * * * *

UNITED STATES PATENT AND TRADEMARK OFFICE

CERTIFICATE OF CORRECTION

PATENT NO. : 5,232,892

DATED : August 3, 1993

INVENTOR(S) : Chang et al.

It is certified that error appears in the above-indentified patent and that said Letters Patent is hereby corrected as shown below:

Column 7, line 50, delete "7' th" and insert --7th was step was--.

Column 7, line 66, delete "7' th" and insert --7th--.

Column 11, line 13, delete "12and" and insert --12, and--.

Signed and Sealed this

Twenty-seventh Day of September, 1994

Bruce Lehman

*Attest:*

BRUCE LEHMAN

*Attesting Officer*

*Commissioner of Patents and Trademarks*